United States Patent [19]

Gallo

[11] 3,981,106

[45] Sept. 21, 1976

[54] SCRUBBER-SANDER WITH CLEANER DISPENSING MEANS

[76] Inventor: Alfredo Gallo, 483 NE. 29th St., Miami, Fla. 33137

[22] Filed: Apr. 29, 1975

[21] Appl. No.: 572,922

[52] U.S. Cl. ..... 51/358; 15/231; 401/4; 401/270

[51] Int. Cl.[2] ..... B24D 17/00; A46B 11/04

[58] Field of Search ..... 15/22 R, 231, 232; 401/196, 200, 202, 207, 270–271, 276, 278–281, 4; 51/358

[56] References Cited

UNITED STATES PATENTS

| | | | |
|---|---|---|---|
| 1,121,788 | 12/1914 | Bongiovanni | 401/281 |
| 1,481,499 | 1/1924 | Bongiovanni | 401/281 |
| 1,767,766 | 6/1930 | Lunkenheimer | 15/231 |
| 1,961,518 | 6/1934 | Larkin | 401/270 |
| 2,736,914 | 3/1956 | Ratliff | 401/281 |
| 2,963,728 | 12/1960 | Michaely | 401/270 |
| 3,597,098 | 8/1971 | Kellis | 401/281 |

*Primary Examiner*—Al Lawrence Smith
*Assistant Examiner*—Nicholas P. Godici
*Attorney, Agent, or Firm*—Clarence A. O'Brien; Harvey B. Jacobson

[57] ABSTRACT

A hollow body closed at its lower end by means of a bottom wall is provided and the body includes an upper filler opening for introducing a selected fluent material into the body. A false bottom wall is disposed in surface-to-surface engagement with and underlies the bottom wall and is oscillatably supported from the latter for shifting between first and second positions. The bottom wall and false bottom wall have openings formed therethrough which are disposed out of registry with each other when the false bottom wall is in its first position and registered with each other when the false bottom wall is disposed in the second position thereof, whereby fluent material within the hollow body may flow, by gravity, downwardly through the openings formed in the bottom wall and the false bottom wall. Structure is provided for yieldingly biasing the false bottom wall to the first position thereof and a support plate is supported from the body in spaced relation below the bottom wall and has fluent material openings formed therethough. The underside of the plate is provided with an interchangeable pad of scouring material, a brush body or a sanding head and the scrubber body of the instant invention may therefore also be utilized as a sander.

11 Claims, 7 Drawing Figures

SCRUBBER-SANDER WITH CLEANER DISPENSING MEANS

BACKGROUND OF THE INVENTION

Various forms of absorbent, scouring, scrubbing, brushing and sanding assemblies have been heretofore provided and include reservoirs for containing fluent material as well as means whereby the fluent material in the reservoir may be selectively dispensed therefrom. However, these previously known devices have been relatively complex in structure and have not been constructed in a manner such that they may be readily utilized in an efficient manner as a hand scrubbing, brushing or sanding tool.

Examples of previously patented devices including some of the general structural features of the instant invention are disclosed in U.S. Pat. Nos. 391,581, 1,121,788, 1,545,392, 1,560,841, 1,861,773, 1,931,977, 2,115,943 and 2,736,914.

BRIEF DESCRIPTION OF THE INVENTION

The scrubber sander and scouring apparatus of the instant invention has been constructed in a manner whereby scrubbing and cleaning liquids may be dispensed into the scrubbing pad or brush head and a lubricating fluid such as water or the like may be dispensed to the sanding head in the event the scrubber-sander is to be utilized for wet sanding operations.

The scrubber-sander is constructed in a manner whereby it may be readily grasped, handled and manipulated to carry out various scrubbing, scouring, brushing and sanding operations. Further, the apparatus includes structural features thereof which may be readily manufactured by molding processes and it is proposed that while more durable materials such as metals may be utilized in constructing a heavy duty apparatus, plastic materials which may be readily molded may be utilized in constructing a scrubber-sander and scouring apparatus for home use and specifically for use in the kitchen and/or laundry room where cleaning problems tend to be greater.

The main object of this invention is to provide a scrubbing, scouring and sanding apparatus which may be readily used for various scrubbing, scouring and sanding operations.

Another object of this invention is to provide a scrubber-sander and scouring apparatus including means by which fluent cleaning materials may be readily dispensed to a scrubbing, scouring or brushing head carried by the apparatus.

Yet another object of this invention is to provide an apparatus including means by which a lubricating fluid such as water may be dispensed to a sanding head carried by the invention when it is to be utilized in performing sanding operations.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
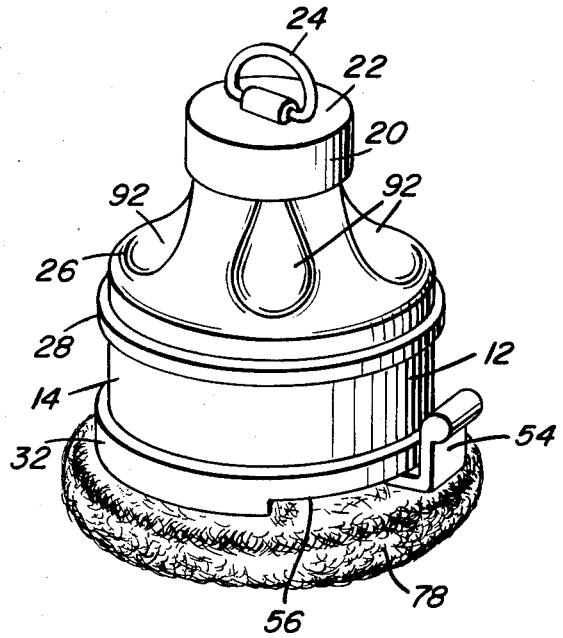
FIG. 1 is a perspective view of a preferred form of scrubber-sander constructed in accordance with the present invention.
Figure 2:
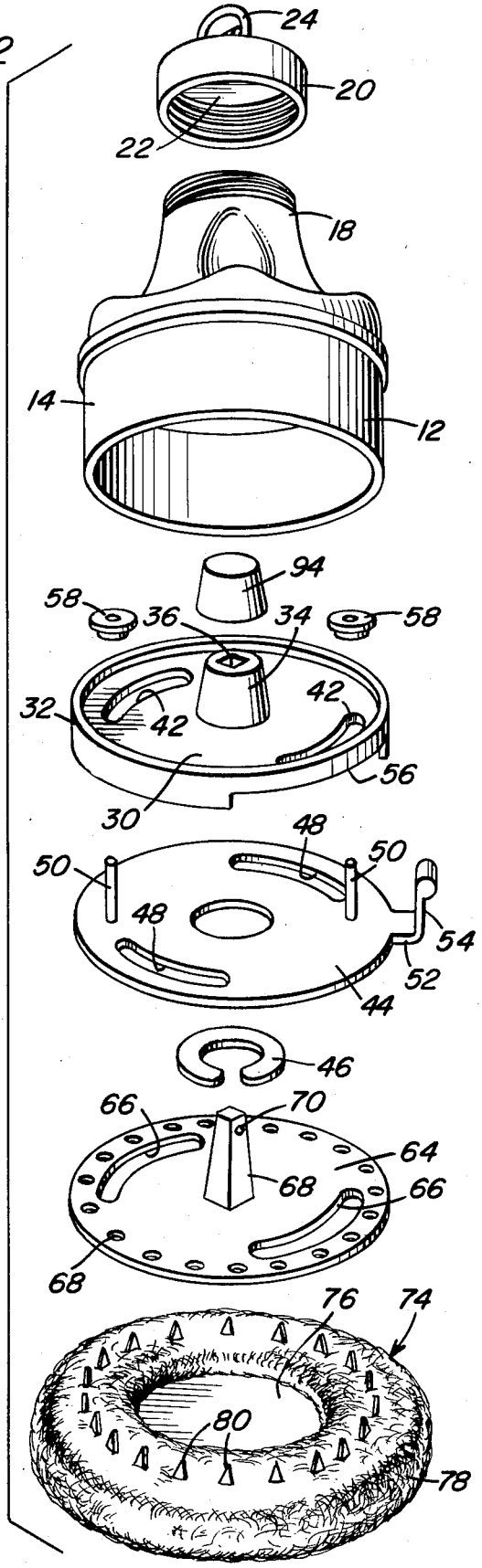
FIG. 2 is an exploded perspective view of the assemblage illustrated in FIG. 1.
Figure 3:
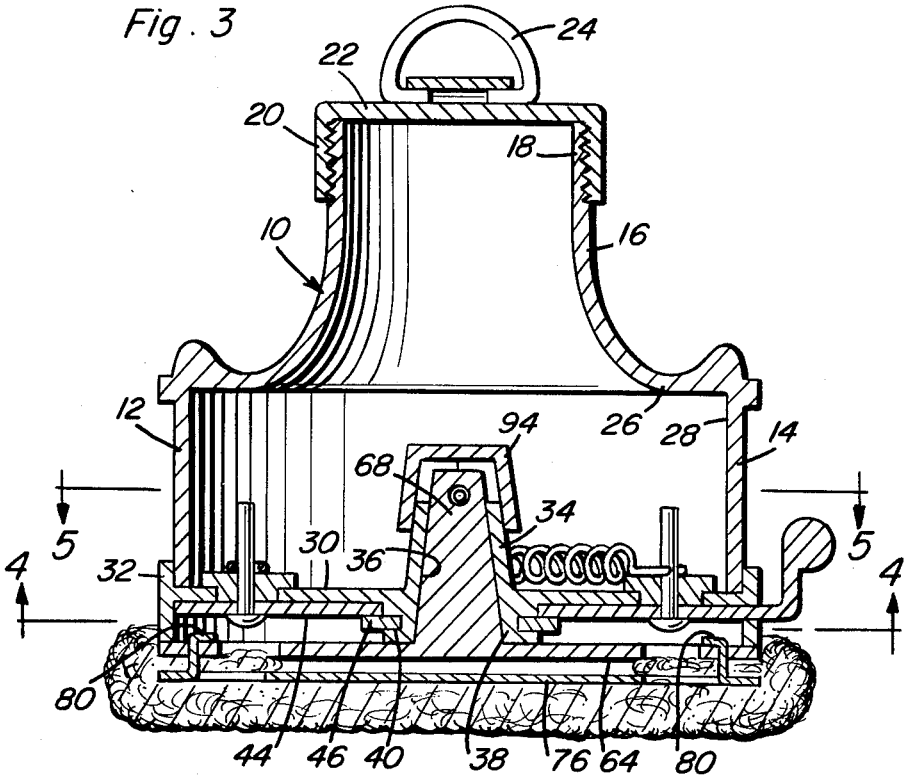
FIG. 3 is an enlarged fragmentary vertical sectional view of the structure illustrated in FIG. I.
Figure 4:
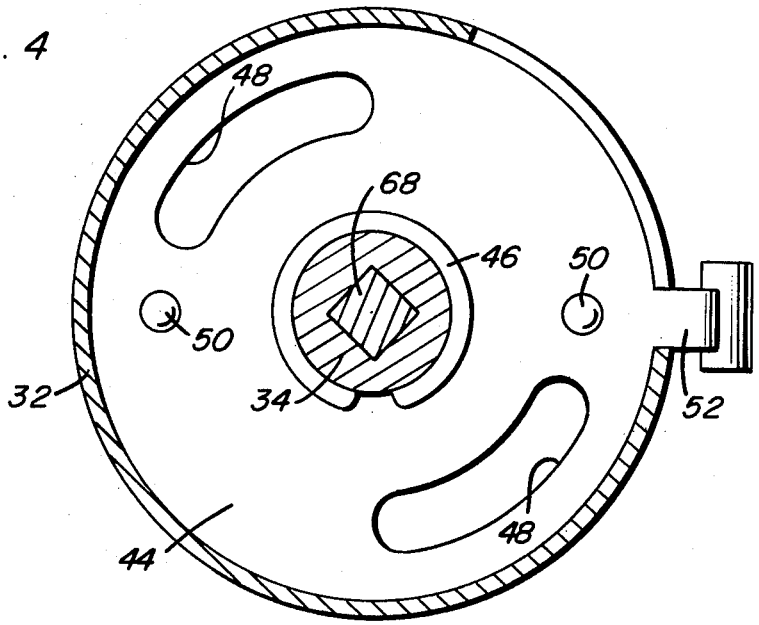
FIG. 4 is a horizontal sectional view taken substantially upon the plane indicated by the section line 4—4 of FIG. 3.

Referring now more specifically to FIGS. 1, 2 and 3 of the drawings, the numeral 10 generally designates the scrubber-sander of the instant invention. The scrubber-sander includes a hollow body 12 including a generally cylindrical lower portion 14 and a bell-shaped upper portion 16. The upper extremity of the upper portion 16 defines an externally threaded and upwardly opening central inlet neck 18 and a closure cap 20 is downwardly threadedly secured over the inlet neck 18. The top wall 22 of the cap 20 includes a pivotally supported suspension eye 24 whereby the scrubber-sander 10 may be readily supported from a suspension hook.

The lower extremity or skirt portion 26 of the bell-shaped upper portion 16 is formed integrally with the upper extremity 28 of the upstanding cylindrical lower portion 14.

The lower end of the body 12 is closed by means of a horizontal bottom wall 30 defining a partition extending diametrically across the interior of a sleeve 32 whose upper end is telescoped over and secured to the lower end of the lower portion 14. In addition, the bottom wall 30 includes an upwardly tapering sleeve formed integrally therewith and extending centrally therethrough. The sleeve is referred to by the reference numeral 34 and defines an upwardly tapering pyramidal passage 36 extending therethrough. The sleeve 34 includes a lower portion 38 which projects below bottom wall 30 and includes a circumferential outwardly opening groove 40. Still further, the bottom wall 30 includes diametrically opposite arcuate openings 42 formed therethrough.

An annular false bottom wall 44 closely underlies the bottom wall 30 in surface-to-surface contacting engagement therewith and a removable snap ring 46 is engaged in the groove 40 immediately beneath the inner periphery of the false bottom wall 44 and retains the latter in position in surface-to-surface contact with the undersurface of the bottom wall 30. The false bottom wall 44 has a pair of arcuate openings 48 formed therethrough and includes a pair of upstanding pins 50 which project through the openings 42 formed in the bottom wall 30. In addition, the false bottom wall 44 includes a radially outwardly projecting outer peripheral tongue 52 which terminates outwardly in an upwardly directed handle 54, the tongue 52 being received through and slidable in a window 56 formed in the sleeve 32 below the bottom wall 44.

A pair of slide-and-guide washers 58 are disposed on the portions of the pins 50 projecting upwardly through the openings 42 and the diametrically reduced lower portions of the washers 58 are slidably received in the slots 42. In addition, the interior of the cylindrical lower portion 14 of the body 12 includes a pair of diametrically opposite inwardly projecting hooks 60, see FIGS. 5 and 6, and a pair of expansion springs 62 are connected between the hooks 60 and corresponding pins 50.

Figure 5:
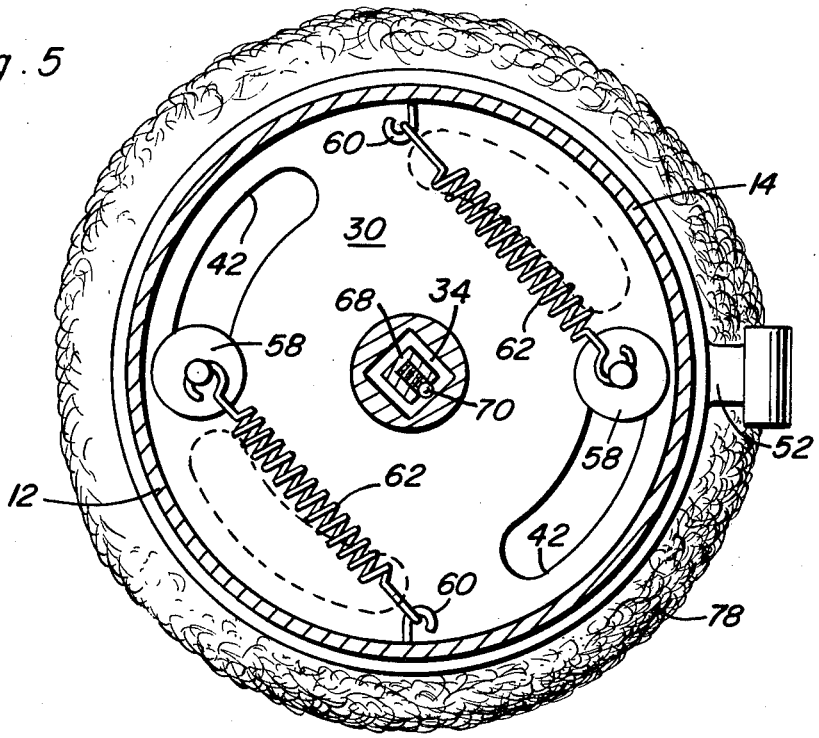
FIG. 5 is a horizontal sectional view taken substantially upon the plane indicated by the section line 5—5 of FIG. 3 and with the fluent material dispensing structure thereof in the closed position.
Figure 6:
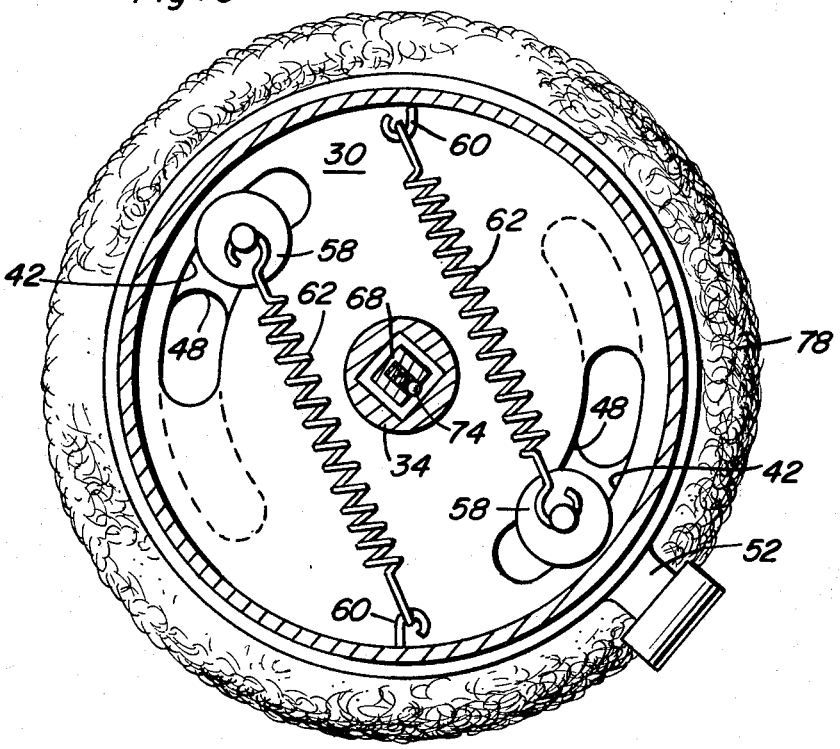
FIG. 6 is a horizontal sectional view similar to FIG. 5 but with the fluent material dispensing mechanism in a partially open position.

The seating of the washers 58 in the ends of the slots 42 limit oscillation of the false bottom wall 44 relative to the bottom wall 30 between positions with the openings 42 and 48 out of registry with each other and positions with the openings 48 registered with the openings 42, see FIGS. 5 and 6, respectively.

Disposed below the false bottom wall 44 is a circular mounting plate 64 having arcuate openings 66 formed therethrough and peripherally spaced apertures 68 formed therethrough. The central area of the mounting plate or disk 64 includes an upstanding truncated pyramidal shank 68 which is snugly and sealingly receivable in the passage 36 with the upper end of the shank 68 projecting above the upper end of the passage 36 and the upper end of the shank 36 includes a spring-biased ball detent 70 which is projectable outwardly from a full retracted position to a partially extended position immediately over the upper end of the sleeve 34 when the shank 68 is fully seated within the passage 36.

A scrubbing head referred to in general by the reference numeral 74 is provided and includes a mounting plate 76 whose undersurface and peripheral edges are covered by suitable scouring material 78. In addition, the plate 76 includes upwardly projecting bendable tines 80 which are receivable upwardly through the apertures 68 and thereafter bendable to the right angular positions thereof illustrated in FIG. 3 in order to secure the plate 76 to the mounting plate or disk 64. In operation, a suitable fluent cleaning material (either a powder or a liquid) may be placed within the hollow body 12 and the cap or cover 20 may be replaced thereon. Then, the mounting plate 64 with the plate 76 supported therefrom is upwardly displaced toward the false bottom wall 44 so as to upwardly telescope the shank 68 into and partially through the passage 36. After the spring-biased ball detent 70 has retained the shank 68 in its fully seated position within the passage 36, the scrubber-sander 10 may be utilized to carry out a scrubbing operation. At any time it is desired to discharge fluent material from within the hollow body 12 down through the openings 42, 48 and 66, the handle 54 is swung from the three o'clock position thereof illustrated in FIG. 5 toward the four-thirty position thereof illustrated in FIG. 6 whereby fluent material within the body 12 will flow downwardly through the partially registered openings 42 and 48 and thereafter downwardly through the openings 66. As soon as the desired quantity of fluent material has been allowed to be dispensed from the body 12, the handle 54 may be released whereby the spring 62 will return the false bottom wall 44 to the position thereof illustrated in FIG. 5 with the openings 48 and 42 out of registry with each other.

Figure 7:
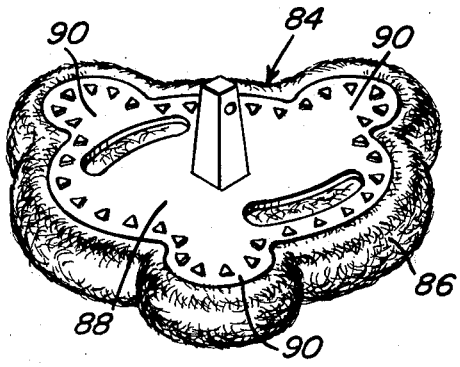
FIG. 7 is a perspective view of a second form of scrubbing head which may be utilized in conjunction with the scrubber-sander.

With attention now invited more specifically to FIG. 7 of the drawings, there will be seen a modified form of scrubbing head referred to in general by the reference numeral 84 and which is very similar to the scrubbing head 74 except that the scrubber body 86 thereof directly underlies the mounting plate 88 corresponding to the mounting plate or disk 64. Further, the mounting plate or disk 88 includes three circumferentially spaced radially outwardly projecting portions 90 which provide a different scrubbing action. Of course, the assembly 84 may be utilized in lieu of the mounting plate 64 and the assembly 74.

Further, a suitable sanding head (not shown) constructed somewhat in accordance with the assembly 74 may be also alternately utilized. Still further, it will be noted that the bell-shaped upper portion 16 of the body 12 includes peripherally spaced outwardly opening exterior finger-receiving recesses 92 which facilitate the handling of the scrubber-sander. Also, a removable downwardly opening cap 94 is secured over the upper end of the sleeve 34 in order to prevent fluent material sloshing around within the body from passing downwardly through the sleeve 34.

The scrubbing heads 74 and 84 may be quickly changed as desired inasmuch as the spring-biased detents thereof allow quick removal and replacement of either head 74 and 84.

The upstanding pins 50 project considerably up into the interior of the lower portion 14 and thereby function to agitate any dry fluent material therein to insure dispensing of such material downwardly from the body 12 when the handle 54 is swung between the position thereof illustrated in FIGS. 5 and 6.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A scrubber body comprising a hollow body closed at its lower end by means of a bottom wall, said body including an upper filler opening for introducing a selected fluent material into said body, said bottom wall having an outlet opening formed therein for gravity discharge of fluent material therethrough from within said body, said bottom wall including valve means guidingly supported therefrom operably associated with said outlet opening and shiftable relative to said bottom wall between open and closed positions, a scrubber member supported from said body beneath said bottom wall and said outlet opening penetrable by fluent material, valve means including a valve plate closely underlying said bottom wall and oscillatably supported therefrom, said valve plate including a discharge opening formed therethrough shiftable into and out of registry with said outlet opening upon oscillation of said valve plate relative to said bottom wall, said bottom wall and valve plate including corresponding central portions, said central portions including coacting mounting means rotatably supporting the central portion of said valve plate from the central portion of said bottom wall for oscillation about an upstanding axis extending generally centrally through said body.

2. The combination of claim 1 wherein said outlet and discharge openings are spaced radially outwardly of said axis.

3. The combination of claim 2 wherein said bottom wall and valve plate include pairs of corresponding selectively registrable outlet and discharge openings formed therein and spaced about said axis.

4. The combination of claim 1 including an upstanding sleeve supported from and extending through said bottom wall, said scrubber member including a mounting plate underlying said valve plate and provided with an upstanding shank portion removably secured in said sleeve against rotation relative to said bottom wall, the portion of said sleeve projecting below said bottom wall and the central portion of said valve plate comprising said mounting means.

5. The combination of claim 4 wherein said mounting plate is generally circular in plan shape.

6. The combination of claim 4 wherein said sleeve defines an upwardly tapering and downwardly opening socket, said shank portion tapering upwardly and being upwardly seated in said socket.

7. The combination of claim 6 wherein the upper portions of said sleeve and said shank portion including releasable means securing said shank portion within said socket.

8. The combination of claim 4 wherein said mounting plate is generally circular in plan shape, but includes circumferentially spaced radially outwardly projecting portions.

9. The combination of claim 1 including means yieldingly biasing said valve plate away from a position with said discharge opening registered with said outlet opening toward a position with said discharge opening out of registry with said outlet opening.

10. The combination of claim 9 wherein said means yieldingly biasing said valve plate including means limiting oscillation of said valve plate in both directions.

11. A scrubber body comprising a hollow body closed at its lower end by means of a bottom wall, said body including an upper filler opening for introducing a selected fluent material into said body, said bottom wall having an outlet opening formed therein for gravity discharge of fluent material therethrough from within said body, said bottom wall including valve means guidingly supported therefrom operably associated with said outlet opening and shiftable relative to said bottom wall between open and closed positions, a scrubber member supported from said body beneath said bottom wall and said outlet opening penetrable by fluent material, said valve means including portions thereof projecting into the lower portion of the interior of said body adjacent said outlet opening and shiftable with said valve means for agitating dry fluent material within said body to be discharged therefrom through said outlet opening.

* * * * *